United States Patent [19]

Ciccarelli

[11] 4,263,389

[45] Apr. 21, 1981

[54] POSITIVELY CHARGED TONERS CONTAINING VINYL PYRROLIDONE POLYMERS

[75] Inventor: Roger N. Ciccarelli, Rochester, N.Y.

[73] Assignee: Xerox Corporation, Stamford, Conn.

[21] Appl. No.: 57,630

[22] Filed: Jul. 16, 1979

[51] Int. Cl.[3] ..... G03G 9/00

[52] U.S. Cl. ..... 430/106; 430/107; 430/108; 430/109; 430/110; 430/120

[58] Field of Search ..... 430/105, 106, 107, 108, 430/109, 110, 111, 120

[56] References Cited

U.S. PATENT DOCUMENTS

| | | | |
|---|---|---|---|
| 3,609,082 | 9/1971 | Moriconi et al. | 430/109 |
| 3,834,930 | 9/1974 | Amidon et al. | 430/109 |
| 3,876,610 | 4/1975 | Timmerman | 430/109 |
| 3,893,933 | 7/1975 | Brown | 430/109 |
| 3,893,935 | 7/1975 | Jadwin | 252/62.1 |
| 3,904,562 | 9/1975 | Hopfenberg et al. | 430/111 |
| 3,944,493 | 3/1976 | Jadwin | 252/62.1 |
| 3,959,404 | 5/1976 | Labana et al. | 430/109 |
| 3,970,571 | 7/1976 | Olson et al. | 252/62.1 |
| 3,985,664 | 10/1976 | Sakaguchi et al. | 252/62.1 |
| 4,016,099 | 4/1977 | Wellman | 430/109 |
| 4,070,296 | 1/1978 | Gibson | 430/109 |
| 4,079,014 | 3/1978 | Burness et al. | 252/62.1 |
| 4,097,404 | 6/1978 | Brown | 430/109 |

*Primary Examiner*—Mary F. Downey

*Attorney, Agent, or Firm*—H. M. Brownrout; P. H. Kondo; E. O. Palazzo

[57] ABSTRACT

Disclosed is a positively charged toner composition comprised of a resin, a colorant and polymers of vinyl pyrrolidone of the formula:

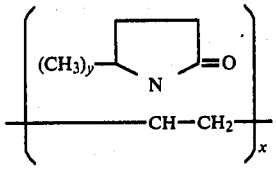

wherein x is a number of from about 20 to 1,800 and y is zero, or 1. A developer material is typically formulated by adding a carrier to the toner composition. Images of high quality are obtained when using these developers in an electrophotographic imaging system. The polymers of vinyl pyrrolidone are also useful as dispersants.

8 Claims, No Drawings

POSITIVELY CHARGED TONERS CONTAINING VINYL PYRROLIDONE POLYMERS

This invention relates generally to new toners which have been charged positively and the utilization of these toners in electrophotographic imaging systems. More specifically, the present invention is directed to positively charged toner compositions which contain as an additive a vinyl pyrrolidone polymeric material; and to the use of such vinyl pyrrolidone materials as dispersants.

The use of toner materials for causing the development of images particularly electrostatic images in the xerographic process is well-known. The toner is present as part of a developer composition which contains a resin, a pigment and a carrier and it is this developer composition that is used for application to the electrostatic latent image by methods that are well-known including, for example, cascade development as described in U.S. Pat. No. 3,618,552, magnetic brush development as described in U.S. Pat. Nos. 2,874,063, and 3,357,402, powder cloud development as described in U.S. Pat. No. 2,221,776 and touchdown development as described in U.S. Pat. No. 3,116,432. There are also known reversal developers of the type as described in U.S. Pat. No. 2,986,521 wherein there is developed a reverse copy of an original in an electrophotographic imaging system. Thus, for example, one may desire to produce a negative copy from a positive original or a positive copy from a negative original, and this can be effected by applying to the image a developer powder which is repelled by the charged areas of the image, and adheres to the discharge areas. Developers containing positively charged toners are found to be very useful and effective in such systems, particularly when organic photoreceptors are used which in many instances are initially charged negatively rather than positively.

The use of charge control agents in developers is known, for example, as described in U.S. Pat. No. 3,893,935, such charge control agents being used for the purpose of imparting a particular charge to the toner. However, there continues to be a need for materials which will impart a positive charge to a toner, or a negative charge to a carrier, and that are of sufficiently high constant value. Some of the prior art toners including those of the '935 patent are humidity sensitive and are therefore incompatible with the thermoplastic resin thus, making it rather difficult to uniformly disperse or dissolve such materials in the toner. This causes particle to particle non-uniformity and a wide distribution of electrical charges which in turn reduces the quality of the image developed.

SUMMARY OF THE INVENTION

It is an object of this invention to provide a toner which overcomes the above-noted disadvantages.

It is an object of this invention to provide toners which contain a high positive charge over a long period of time.

It is another object of this invention to provide developers which contain a positively charged toner and a negatively charged carrier.

Still another object of this invention is to provide developers containing toners and carriers of improved triboelectric charge.

It is yet another object of this invention to provide deveoplers containing toners which maintain their high positive charge over a long period of time.

Also it is an object of this invention to provide materials which function both as a tribo control agent and as a dispersant.

An additional object of the present invention is to provide toners which will develop electrostatic images containing negative charges on a photoreceptor surface, and which will transfer effectively electrostatically.

These and other objects of the present invention are accomplished by providing toners comprised of a toner resin, a colorant, and polymers of vinyl pyrrolidone of the formula:

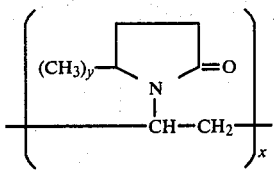

wherein x is a number of from about 20 to 1,800 and preferably from about 100 to 1,400, and y is zero (0) or one (1). The molecular weight of these materials would thus range from 5,000 to 300,000.

The resulting toner when present in a developer composition containing carrier, due to the presence of the polyvinyl pyrrolidone either as homopolymers or copolymers and terpolymers thereof contains a positive charge on the surface, thus allowing such a toner to be used for the development of electrostatic images wherein a photoreceptor is employed containing a negative charge thereon.

Examples of monomers polymerized with vinyl pyrrolidone in order to form the polyvinyl pyrrolidone copolymers of the present invention includes, but is not limited to alkylmethacrylates-acrylates such as butylmethacrylates, methylmethacrylates and the like.

Illustrative examples of polyvinyl pyrrolidones useful as additives and dispersants include for example, styrene/butylmethacrylate/vinyl pyrrolidone terepolymers, vinyl pyrrolidone/vinyl acetate copolymers, vinyl pyrrolidone homopolymers, and the like.

The polyvinyl pyrrolidone polymers of the present invention can be used in various amounts and can be incorporated into the toner in a number of different ways providing there results a toner that is charged positively in comparison to the carrier, and it develops and electrostatically transfers well. The polyvinyl pyrrolidone polymer can be blended in with the toner resin or it can be coated on the colorant such as carbon black which is used in the developing composition. The polyvinyl pyrrolidone polymer can also be chemically incorporated into the base toner resin by any suitable method including for example, copolymerization of vinyl pyrrolidone with a styrene/n-butyl methacrylate copolymer. The amount of polyvinyl pyrrolidone that is present when it is blended in with the toner ranges from about 0.5 weight percent to about 15 weight percent of the toner weight and preferably from 2 weight percent to about 6 weight percent. When coated on the pigment, the amount of polyvinyl pyrrolidone used ranges from about 3 percent to 25 percent, and preferably 5 percent to 20 percent.

There are several methods that can be employed to produce the toner of the present invention including, for example, melt blending the resin and the colorant, which may be coated with the polyvinyl pyrrolidone polymer of the present invention followed by mechanical attrition. Illustrative examples of other methods include spray drying, melt dispersion, and dispersion polymerization. For example, a solvent dispersion of resin, colorant or pigment, and a polyvinyl pyrrolidone polymer can be spray dried under controlled conditions thus resulting in the desired product. The polyvinyl pyrrolidone polymer can also be incorporated into the toner by chemical incorporation of such a material in the base resin as mentioned hereinbefore, such as for example, copolymerization of the vinyl pyrrolidone with styrene/n-butylmethacrylate. Methods of preparation, properties and uses of these types of polymers and related polymers are described in the text Functional Monomers, Their Preparation, Polymerization, and Application, Edited by R. H. Yocum and E. B. Nyquist, published by M. Dekker Inc., New York 1974, especially Volume 2, Pages 132 to 144 totally incorporated herein by reference.

By incorporating the polyvinyl pyrrolidone polymer of the present invention into the toner, the toner in effect becomes conditioned, that is, it acquires a positive charge when admixed with carrier material and this positive charge is maintained substantially over the life of the developer. The polyvinyl pyrrolidone polymers thus, as demonstrated in the working examples, are effective materials for controlling the triboelectric properties particularly the triboelectric charge for reversal developers.

Different numerous types of resins or polymers may be employed in the present invention as part of the base toner with the polyvinyl pyrrolidone polymer, such resins including for example, polyamides, epoxies, polyurethanes, vinyl resins, polymeric esterification products of a dicarboxylic acid and a diol, resin modified maleic alkyd resins, phenolformaldehyde resins, and the like. Illustrative vinyl resins which may be employed in the toners of the present invention include homopolymers or copolymers of two or more vinyl monomers, such monomers being vinyl monomeric units including styrene and substituted styrenes, p-chlorostyrene, vinyl naphthalene, ethylenecally unsaturated mono-olefins such as ethylene, propylene, butylene, isobutylene and the like; vinyl monomers, and vinyl esters such as vinyl choloride, vinyl bromide, vinyl fluoride, vinyl acetate, vinyl propionate, vinyl benzoate, vinyl butyrate and the like; vinyl esters of monocarboxylic acids such as methyl acrylate, ethyl acrylate, n-butylacrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, butyl methacrylate and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl indole, N-vinyl pyrrolidone and the like; and mixtures thereof.

Generally toner resins containing a relatively high percentage of styrene are preferred since greater image definition and density is obtained with their use. The styrene resin employed may be a homopolymer of styrene or styrene homologs or copolymers of styrene with other monomeric groups containing a single methylene group attached to a carbon atom by a double bond. Any of the above typical monomeric units may be copolymerized with styrene by addition polymerization. Styrene resins may also be formed by the polymerization of mixtures of two or more unsaturated monomeric materials with a styrene monomer. The addition polymerization technique employed embraces known polymerization techniques such as free radical, anionic and cationic polymerization processes. Any of these vinyl resins may be blended with one or more resins if desired, preferably other vinyl resins which insure good triboelectric properties and uniform resistance against physical degradation. However, non-vinyl type thermoplastic resins may also be employed including resin modified phenolformaldehyde resins, oil modified epoxy resins, polyurethane resins, cellulosic resins, polyether resins and mixtures thereof.

Esterification products of a dicaroxylic acid and a diol may also be employed in the present invention as a preferred resin material which materials are illustrated in U.S. Pat. No. 3,655,374 totally incorporated herein by reference.

Optimum electrophotographic results are achieved with styrene butylmethacrylate copolymers, styrene vinyl toluene copolymers, styrene acrylate copolymers, polyester resins, predominantly styrene or polystyrene base resins as generally described in U.S. Pat. No. 25,136 to Carlson and polystyrene blends as described in U.S. Pat. No. 2,788,288 to Rheinfrank and Jones.

Any suitable colorant, pigment or dye may be employed as the colorant for the other particles, such materials being well-known and including for example, carbon black, nigrosine dye, aniline blue, calco oil blue, chrome yellow, ultramarine blue, DuPont oil red, methylene blue chloride, phthalocyanine blue and mixtures thereof. The pigment or dye should be present in the toner and in sufficient quantity to render it highly colored so that it will form a clearly visible image on the recording member. For example, where conventional xerographic copies of documents are desired, the toner may comprise a black pigment such as carbon black or a black dye such as Amaplast black dye available from the National Aniline Products Inc. Preferably the pigment is employed in amounts from about 3 percent to about 20 percent by weight based on the total weight of toner, however, if the other color employed is a dye, substantially smaller quantities of the color may be used.

Any suitable carrier material can be employed as long as such particles are capable of triboelectrically obtaining a charge of opposite polarity to that of the toner particles, in the present invention in one embodiment that would be a negative polarity, to that of the toner particles which are positively charged so that the toner particles will adhere to and surround the carrier particles. Thus the carriers can be selected so that the toner particles acquire a charge of a positive polarity and include materials such as sodium chloride, ammonium chloride, ammonium potassium chloride, Rochelle salt, sodium nitrate, aluminum nitrate, potassium chlorate, granular zircon, granular silicon, methylmethacrylate, glass, steel, nickel, iron ferrites, silicon dioxide and the like. The carriers can be used with or without a polymer coating, such coatings including fluorocarbon polymers. Many of the typical carriers that can be used are described in U.S. Pat. Nos. 2,618,441; 2,638,416; 2,618,552; 3,591,503; 3,533,835, and 3,526,533. Also nickel berry carriers as described in U.S. Pat. Nos. 3,847,604, and 3,767,598 can be employed, these carriers being nodular carrier beads of nickel characterized by surface of reoccuring recesses and protrusions providing particles with a relatively large external area. The diameter of the coated carrier particle is from about 50 to about 1,000 microns, thus allowing the carrier to possess sufficient density and inertia to avoid adherence to the electrostatic images during the development process. Other carrier materials that may be used in the present invention include, for example, polymer coated iron cores.

As a developer the carrier may be employed with the toner composition in any suitable combination, however best results are obtained when about 1 part per toner is used and about 10 to about 200 parts by weight of carrier.

Toner compositions of the present invention may be used to develop electrostatic latent images on any suitable electrostatic surface capable of retaining charge including conventional inorganic or organic photoconductors, however, the toners of the present invention are best utilized in systems wherein a negative charge resides on the photoreceptor and this usually occurs with organic photoreceptors, illustrative examples of such photoreceptors being polyvinyl carbazole, 4-dimethylamino-benzylidene, benzhydrazide; 2-benzylidene-amino-carbazole, polyvinyl carbazole; (2-nitro-benzylidene) p-bromo-aniline; 2,4-diphenyl-quinazoline; 1,2,4-triazine; 1,5-diphenyl-3-methyl pyrazoline 2-(4'-dimethyl-amino phenyl)-benzoxazole; 3-amino-carbazole; polyvinylcarbazole-tritrofluoroenone charge transfer complex; phthalocyanines and mixtures thereof.

The following examples are being supplied to further define the species of the present invention, it being noted that these examples are intended to illustrate and not limit the scope of the present invention. Parts and percentages are by weight unless otherwise indicated.

EXAMPLE I

A 2 weight percent solution of a copolymer of vinyl pyrrolidone and vinyl acetate in a mole ratio of 60:40 was prepared by diluting 8 grams of vinyl pyrrolidone/-vinylacetate copolymer, available from General Aniline and Film, (E-635) to 200 grams with distilled water. To 150 milliliters of this solution was added 13.5 grams of styrene monomer, 0.70 grams of n-butyl methacrylate monomer, 2.1 grams of a styrene/n-butyl methacrylate grafted Raven 420 carbonb lack and 1.26 grams of lauryl peroxide. The resulting liquid oil-water mixture was sized with a blender equipped with a polytron head and subsequently polymerized for seven hours. After polymerization, filtration, and drying, the resulting toner product was ground and sieved through a 45 um screen. Coulter counter size analysis of the resulting toner material indicated a number medium of 12.9 u, and a volume medium of 28.5 u, hence the material can be used as a toner directly without any further processing.

Three (3) parts per weight of this toner was then mixed together with 97 parts by weight of a steel carrier in order to formulate a developer. This developer was employed in electrophotographic imagining system. High quality images of excellent resolution and good print density were obtained. The polyvinyl pyrrolidone polymer can be blended into the toner resin along with the pigment or it can be polymerized into the polymer (toner resin structure).

The first part of this example demonstrates that polyvinyl pyrrolidone, copolymer of vinyl pyrrolidone and vinyl acetate can be used as a dispersant for the styrene monomer, n-butyl methacrylate grafted Raven 420 carbon black since when a solution of these materials is prepared without the pyrrolidone copolymer a phase separation occurs; and therefore the material is no longer polymerizable.

When 13.25 grams of styrene monomer, 0.70 grams of n-butyl methacrylate monomer, and 2.1 grams of a styrene/n-butyl methacrylate grafted Raven 420 carbon black, 1.2 grams of lauryl peroxide are admixed, followed by sizing with a blender equipped with a polytron head, within five (5) minutes there resulted a phase separation. Accordingly, the material is no longer polymerizable.

EXAMPLE II

Blow off tribo of a toner containing three (3) parts of polyvinyl pyrrolidone toner from Example I was measured and compared with the material of Example I with the exception that it does not contain a polyvinyl pyrrolidone. Charge (microcoulombs uc per gram of toner) on the toner results follow for two different carriers after one minute, 10 minutes, 60 minutes and 24 hour roll mill mixing.

TABLE

CHARGE Q/M (μc MICROCOULOMBS PER GRAM OF TONER) ON THE TONER

| | | Q/M | | | |
|---|---|---|---|---|---|
| Toner | Carrier | 1 min. | 10 min. | 60 min. | 24 hrs. |
| With pyrrolidone polymer | Steel | +3 | +3 | +1 | — |
| Without pyrrolidone polymer | Steel | — | −2 | −3 | −9 |
| With pyrrolidone polymer | Fluorocarbon coated (0.35 wt. %) Iron core carrier | +14 | +19 | +20 | — |

This data indicates that with the polyvinyl pyrrolidone polymer the charge is of the right polarity, positive. Thus it can be used as part of a developer composition for rendering latent images visible in an electrophotographic system.

EXAMPLE III

Seven (7) parts of a toner prepared in accordance with Example I was mixed to form a developer with 93 parts of a fluorocarbon coated carrier (0.35 weight percent) iron core carrier. Images of excellent quality and high density were obtained with the above developer when used in an electrostatic system containing the organic photoconductor polyvinyl carbazole which is negatively charged.

Other modifications of the present invention will occur to those skilled in the art upon a reading of the present disclosure. These are intended to be included within the scope of this invention.

What is claimed is:

1. A positively charged dry toner composition comprised of a resin, a colorant, a carrier, and polymers of vinyl pyrrolidone of the formula:

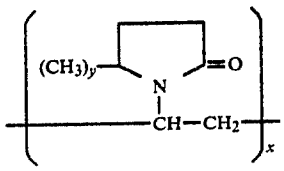

wherein x is a number of from about 20 to 1,800 and y is zero, or 1.

2. A toner composition in accordance with claim 1 wherein y is zero, and the molecular weight of the polyvinyl pyrrolidone is from about 5,000 to about 300,000.

3. A toner composition in accordance with claim 1 wherein the polymer is a styrene/butyl methacrylate/-vinyl pyrrolidone terpolymer, or a vinyl pyrrolidone/-vinyl acetate copolymer.

4. A toner composition in accordance with claim 1 wherein the resin is styrene/n-butyl methacrylate, and the colorant is carbon black.

5. A toner in accordance with claim 1 wherein the polymer of vinyl pyrrolidone is coated on the colorant.

6. A toner in accordance with claim 1 wherein the carrier is steel, or a metal core coated with a fluoropolymer.

7. A method of imaging comprising forming an electrostatic latent image on a photoreceptor which is negatively charged, contacting the image with a positively charged dry developer comprising a resin material, a colorant, a carrier, and polymers of vinyl pyrrolidone of the formula:

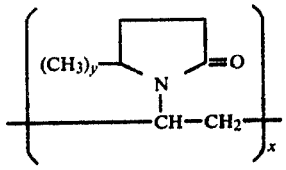

wherein x is a number of from about 20 to 1,800 and y is zero, or 1, subsequently transfferring the developed image to a substrate and permanently affixing the image thereto.

8. A method of imaging in accordance with claim 7 whereby y is zero, and the molecular weight of the polyvinyl pyrrolidone is from about 5,000 to about 300,000.

* * * * *